US009373910B2

(12) United States Patent
Sato

(10) Patent No.: US 9,373,910 B2
(45) Date of Patent: Jun. 21, 2016

(54) CONNECTOR TERMINAL AND MANUFACTURING METHOD OF CONNECTOR TERMINAL

(75) Inventor: Kei Sato, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 14/239,862

(22) PCT Filed: Aug. 17, 2012

(86) PCT No.: PCT/JP2012/071369

§ 371 (c)(1),
(2), (4) Date: Feb. 20, 2014

(87) PCT Pub. No.: WO2013/027810

PCT Pub. Date: Feb. 28, 2013

(65) Prior Publication Data

US 2014/0206245 A1 Jul. 24, 2014

(30) Foreign Application Priority Data

Aug. 23, 2011 (JP) ..... 2011-181776

(51) Int. Cl.

| | |
|---|---|
| ***H01R 13/625*** | (2006.01) |
| ***H01R 13/52*** | (2006.01) |
| ***H01R 43/00*** | (2006.01) |
| ***H01R 13/533*** | (2006.01) |

(Continued)

(52) U.S. Cl.

CPC ..... *H01R 13/52* (2013.01); *H01R 13/533* (2013.01); *H01R 43/005* (2013.01); *H01R 43/16* (2013.01); *H01R 4/184* (2013.01); *Y10T 29/49224* (2015.01)

(58) Field of Classification Search

USPC ..... 439/342, 885, 357, 83, 70, 857

See application file for complete search history.

(56) References Cited

U.S. PATENT DOCUMENTS

| | | | | |
|---|---|---|---|---|
| 3,831,254 | A | 8/1974 | Weber et al. | |
| 4,288,141 | A * | 9/1981 | Leather | 439/395 |

(Continued)

FOREIGN PATENT DOCUMENTS

| | | | |
|---|---|---|---|
| CN | 1661861 | A | 8/2005 |
| CN | 201194308 | Y | 2/2009 |

(Continued)

OTHER PUBLICATIONS

International Search Report (PCT/ISA/210), dated Nov. 7, 2012, issued by the International Searching Authority in counterpart International Patent Application No. PCT/JP2012/071369.

(Continued)

*Primary Examiner* — Phuongchi T Nguyen

(74) *Attorney, Agent, or Firm* — Sughrue Mion, PLLC

(57) ABSTRACT

A connector terminal (10) which includes a barrel portion (21) to which a core wire (12) exposed from an outer cover (13) of an electric cable (11) is electrically connected, a tab terminal portion (31) that is electrically connected to a mating terminal and, a resin mold which covers and waterproofs the barrel portion (21) and an end portion of the electric cable (11). Before the connector terminal (10) is finalized, the connector terminal (10) is connected to a carrier (42) through an interconnection portion (41) and is separated from the carrier (42) at interconnection portion (41). A cutting groove (44) is formed on the interconnection portion (41) along a width direction thereof.

1 Claim, 5 Drawing Sheets

(51) Int. Cl.
*H01R 43/16* (2006.01)
*H01R 4/18* (2006.01)

(56) References Cited

U.S. PATENT DOCUMENTS

| | | | | |
|---|---|---|---|---|
| 4,411,484 | A * | 10/1983 | Casey | 439/422 |
| 5,584,122 | A | 12/1996 | Kato et al. | |
| 6,072,124 | A | 6/2000 | Kato et al. | |
| 6,783,377 | B2 * | 8/2004 | Aoyama | 439/92 |
| 7,955,101 | B2 * | 6/2011 | Lawson et al. | 439/177 |
| 2001/0003687 | A1 | 6/2001 | Kondo | |
| 2005/0191912 | A1 | 9/2005 | Maeda | |
| 2010/0055998 | A1 * | 3/2010 | Aihara | 439/877 |
| 2010/0075535 | A1 * | 3/2010 | Mizutani | H01R 13/504 439/588 |
| 2010/0081325 | A1 | 4/2010 | Matsunaga | |
| 2010/0105256 | A1 | 4/2010 | Lyford et al. | |
| 2012/0036714 | A1 | 2/2012 | Lyford et al. | |

FOREIGN PATENT DOCUMENTS

| | | | |
|---|---|---|---|
| EP | 2 169 771 | A1 | 3/2010 |
| EP | 2 169 784 | A2 | 3/2010 |
| JP | 2001-162647 | A | 6/2001 |
| JP | 2009-99277 | A | 5/2009 |
| JP | 2010-55901 | A | 3/2010 |

OTHER PUBLICATIONS

Written Opinion (PCT/ISA/237), dated Nov. 7, 2012, issued by the International Searching Authority in counterpart International Patent Application No. PCT/JP2012/071369.

Office Action dated Mar. 10, 2015 issued by the Japanese Patent Office in counterpart Japanese Patent Application No. 2011-181776.

Communication from the State Intellectual Property Office of P.R. China dated Dec. 31, 2015 in a counterpart Chinese application No. 201280041220.8.

Office Action dated Jun. 25, 2015 issued by the State Intellectual Property Office of the People's Republic of China in counterpart Chinese Patent Application No. 201280041220.8.

* cited by examiner

CONNECTOR TERMINAL AND MANUFACTURING METHOD OF CONNECTOR TERMINAL

TECHNICAL FIELD

The present invention relates to a connector terminal connected to an end portion of a cable, and a manufacturing method of the connector terminal.

BACKGROUND ART

In the related art, a technique is known in which, in order to maintain a waterproof property in a connector terminal to be connected to an end portion of a cable, a mold portion of a molding cavity is provided inside a molding metallic die configured of upper and lower dies, which accommodates and sets the terminal connection portion that compresses a terminal fitting to a conductor of a front end portion of a coated electric cable, and a mold resin in a molten state is injected into the mold portion and thereby the terminal connection portion is coated and formed (for example, see, Patent Literature 1).

This type of terminal fitting is used to be connected to a carrier through an interconnection portion and to be separated from the carrier by cutting of the interconnection portion (for example, see, Patent Literature 2).

CITATION LIST

Patent Literature

Patent Literature 1: JP-A-2001-162647
Patent Literature 2: JP-A-2009-99277

SUMMARY OF INVENTION

Technical Problem

However, as shown in FIG. 9, when the interconnection portion is cut with a cutter and a terminal fitting 1 is separated from a carrier, a burr A occurs at the cutting position. Thus, in the terminal fitting 1 having the burr A, as shown in FIG. 10, even though a connection position of an electric cable 2 is covered by a resin mold 3, the burr A protrudes from the resin mold 3. Accordingly, there are concerns that a waterproof effect will be insufficient by the resin mold 3 and that the connection position between a core wire 4 of the electric cable 2 and the terminal fitting 1 will be permeated by water.

Specifically, in a case where an aluminum electric cable and a copper terminal are compressed and connected to each other, a connection position formed of different types of metals is permeated by water and electrolytic corrosion such as bimetallic contact corrosion occurs.

The present invention is made in view of the situation described above. An object of the present invention is to provide a connector terminal where a favorable waterproof property and corrosion resistance can be obtained at a connection position with a conductor.

Solution to Problem

In order to achieve the object described above, a connector terminal connected to a carrier according to aspects of the present invention may be configured by the followings (1) to (4).

(1) A connector terminal connected to a carrier, including:

a barrel portion to which a conductor exposed from an outer cover of an electric cable is electrically connected;

a tab terminal portion to be electrically connected to a mating terminal;

an interconnection portion through which the connector terminal is connected to the carrier; and a cutting groove formed on the interconnection portion along a width direction of the interconnection portion.

(2) The connector terminal according to the configuration (1), wherein the cutting groove is formed on a surface opposed to a surface from which the barrel portion and the tab terminal portion are formed.

(3) The connector terminal according to the configuration (1) or (2), wherein the cutting groove is formed in a V-shape, a circular concave shape, or a rectangular concave shape.

(4) The connector terminal according to the configuration (1) or (2), wherein the connector terminal is formed of a copper or a copper alloy, and the electric cable, the conductor of which is formed of an aluminum or an aluminum alloy, is connected to the connector terminal.

In order to achieve the object described above, a manufacturing method of a connector terminal according to an aspect of the present invention may be configured by the following (5).

(5) A manufacturing method of a connector terminal, including:

providing the connector terminal connected to the carrier as defined in the configuration (1) or (2);

cutting the interconnection portion of the connector terminal through the cutting groove from a surface opposite to a surface on which the cutting groove is formed to separate the connector terminal from the carrier; and forming a resin mold which covers and waterproofs the barrel portion and an end portion of the electric cable.

In the connector terminal of the configuration (1) described above, the cutting groove is formed on interconnection portion that is to be cut to separate from the carrier and thereby even though the interconnection portion is cut with a cutter, occurrence of a burr can be suppressed.

Accordingly, a drawback, where a burr protrudes from the resin mold and thereby the waterproof property is reduced, can be overcome. The waterproof property of a connection position with an electric cable can be maintained by the resin mold well for a long period of time and high connection reliability can be obtained.

In the connector terminal of the configuration (2) described above, the cutting groove is formed on a surface opposed to a surface from which the barrel portion and the tab terminal portion are formed, thereby even though the interconnection portion is cut with a cutter, occurrence of a burr can be suppressed.

In the connector terminal of the configuration (3) described above, the cutting groove may have various shapes depending on the situation.

In the connector terminal having the configuration (4) described above, an electric cable having a conductor formed from aluminum or an aluminum alloy, is connected to the connector terminal and thereby, even though copper-aluminum contact, which largely causes electrolytic corrosion due to contact between different types of metals, occurs, the connection position of different types of metals can be reliably waterproofed using a resin mold and favorable corrosion resistance can be secured.

In the manufacturing method of the configuration (5) described above, the connector terminal can be manufactured by which a favorable waterproof property and corrosion resistance can be obtained at a connection position with a conductor.

Advantageous Effects of Invention

According to the present invention, a connector terminal can be provided where a favorable waterproof property and corrosion resistance can be obtained at the connection position with the conductor.

Hereinabove, the present invention is described briefly. Details of the present invention will be clarified further by reading through the embodiments of the present invention described below with reference to the attached drawings.

DESCRIPTION OF EMBODIMENTS

Hereinafter, an embodiment of the present invention is described with reference to the drawings.

Figure 1:
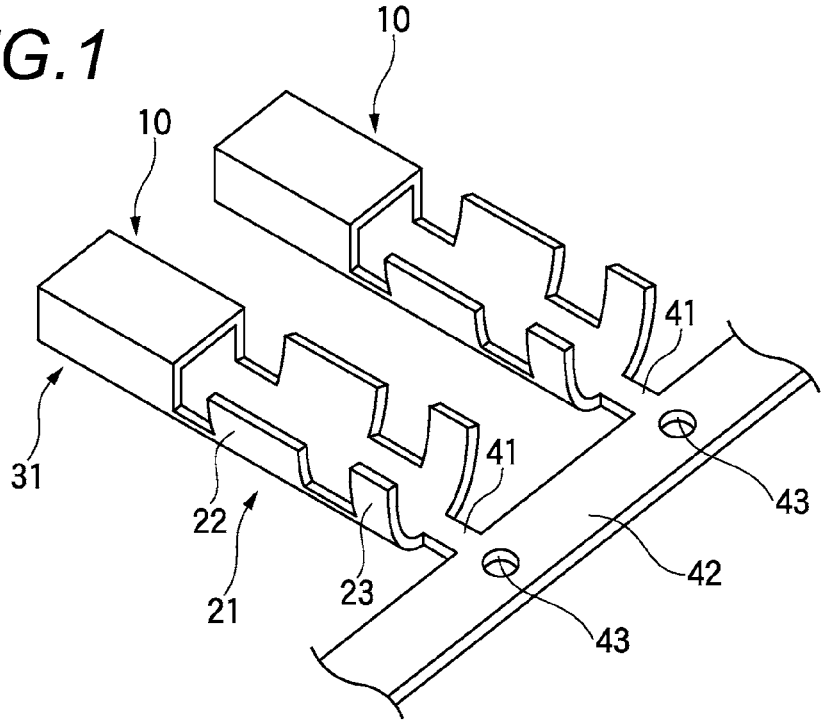
FIG. 1 is a perspective view of a connector terminal connected to a carrier according to an embodiment.
Figure 2:
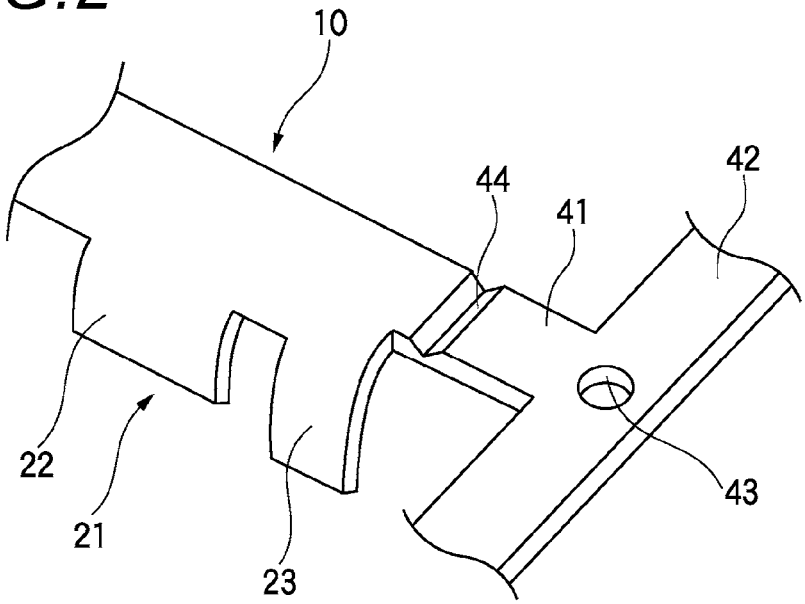
FIG. 2 is a perspective view of the connector terminal connected to the carrier according to the embodiment, as viewed from a back side.
Figure 3:
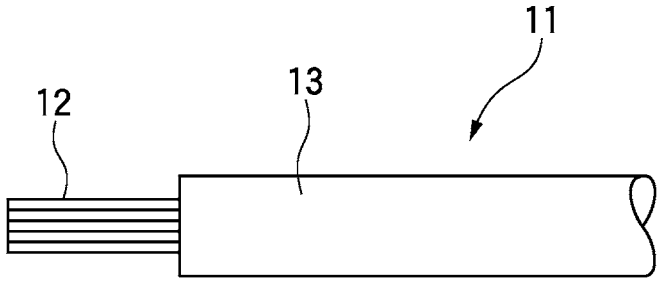
FIG. 3 is a side view of an end portion of an electric cable connected to the connector terminal.
Figure 4:
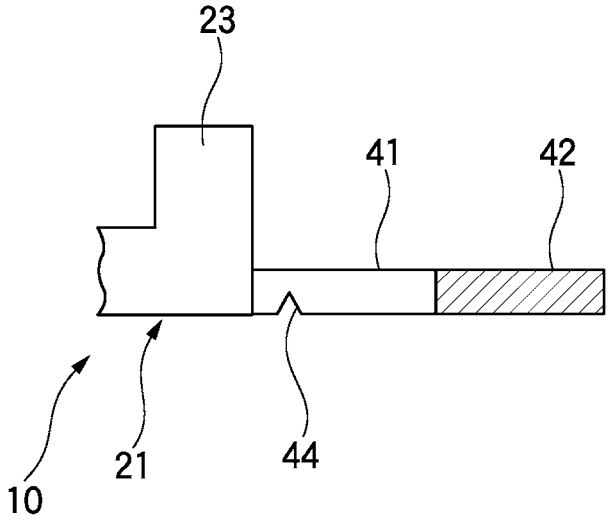
FIG. 4 is a side view of an interconnection portion that interconnects the connector terminal and the carrier.
Figure 5:
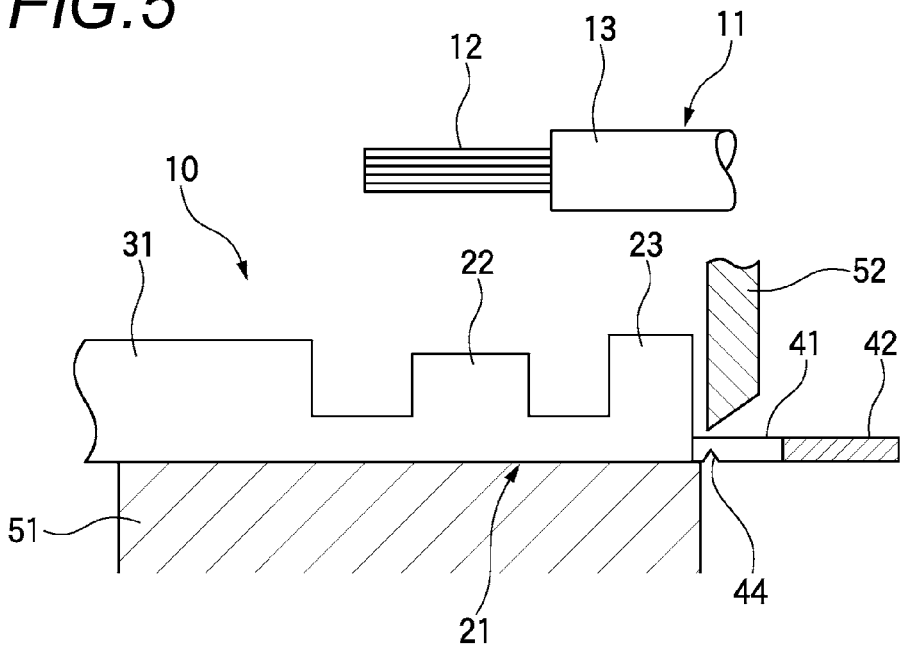
FIG. 5 is a side view explaining a method of connection of the electric cable to the connector terminal.
Figure 6:
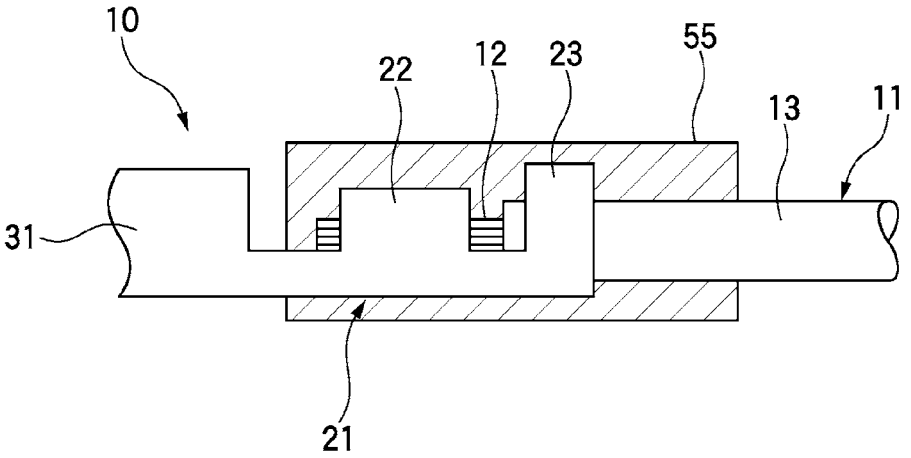
FIG. 6 is a side view of a barrel portion of the connector terminal where a resin mold is provided.

FIG. 1 is a perspective view of a connector terminal connected to a carrier according to the embodiment, FIG. 2 is a perspective view of the connector terminal connected to the carrier according to the embodiment, as viewed from a back side, FIG. 3 is a side view of an end portion of an electric cable connected to the connector terminal, FIG. 4 is a side view of an interconnection portion that interconnects the connector terminal and the carrier, FIG. 5 is a side view explaining method of connection of an electric cable to the connector terminal and FIG. 6 is a side view of a barrel portion of the connector terminal where a resin mold is provided.

As shown in FIGS. 1 and 2, a connector terminal 10 is formed of a conductive metal material such as a copper or a copper alloy with for example, press processing, and has a barrel portion 21 and a tab terminal portion 31.

As shown in FIG. 3, an electric cable 11, in which the connector terminal 10 is connected, has for example, a core wire (a conductor) 12 formed of an aluminum or an aluminum alloy, and an outer cover 13 which is extruded and coated around the core wire 12.

The barrel portion 21 has a core wire crimp part 22 and an outer cover crimp part 23. The core wire crimp part 22 compresses the core wire 12 exposed at an end portion of the electric cable 11. Accordingly, the core wire 12 of the electric cable 11 and the connector terminal 10 are electrically connected. In addition, the outer cover crimp part 23 compresses the outer cover 13 in the end portion of the electric cable 11. Accordingly, the outer cover 13 portion of the electric cable 11 is fixed to the connector terminal 10.

The connector terminal 10 described above is configured such that an interconnection portion 41 is formed at an end portion of the barrel portion 21 side and the end portion thereof is connected to a strip-shaped carrier 42 via the interconnection portion 41. In the carrier 42, fitting holes 43 are provided in a line in the longitudinal direction thereof to fit convex portions (not shown) of transportation equipment such as a robot arm used during assembly of a connector. As described above, the connector terminal 10 corresponds to a chain terminal connected to the carrier 42 and is supplied by a parts feeder (not shown).

The connector terminal 10 is separated from the carrier 42 by cutting the interconnection portion 41 from an upper surface side that is a forming side of the barrel portion 21 to be used.

As shown in FIG. 4, in the interconnection portion 41 that interconnects the connector terminal 10 and the carrier 42, a cutting groove 44 is formed at a portion near the connector terminal 10 through the width direction thereof. The cutting groove 44 is formed at a lower side that is the opposite side to a forming side of the barrel portion 21 that is a front side in a cutting direction in a V-shape in a cross-sectional view.

Next, a case where the electric cable 11 is connected to the connector terminal 10 is described.

As shown in FIG. 5, a cutter 52 moves down in a state where the connector terminal 10, which is connected to the carrier 42 transported from a parts feeder, is arranged in a predetermined position of a die 51. Accordingly, a portion near the connector terminal 10 of the interconnection portion 41 is cut by the cutter 52.

At this time, in the interconnection portion 41, the cutting groove 44 is formed at the front side in the cutting direction at the portion near the connector terminal 10 through the width direction and thereby an external force of the cutter 52 for cutting is focused on a bottom portion of the cutting groove 44. As a result, the occurrence of a burr is suppressed compared to the related art in which the cutting groove 44 is not provided at the interconnection portion 41 and the external force of the cutter 52 for cutting disperses in the interconnection portion 41.

Next, an end portion of the electric cable 11, a core wire 12 of which is exposed, is arranged at the barrel portion 21 of the connector terminal 10, a core wire crimp part 22 and an outer cover crimp part 23 of the barrel portion 21 are crimped and the electric cable 11 is compressed to the connector terminal 10 by a crimper (not shown).

Next, the barrel portion 21 of the connector terminal 10 is covered by a forming die and molten resin is injected into the forming die. As shown in FIG. 6, the periphery of the barrel portion 21 and around the end portion of the electric cable 11 are covered by the resin mold 55. In this way, the connection position of the electric cable 11 is covered by the resin mold 55 at the connector terminal 10 so that the connection position of the electric cable 11 can be reliably waterproofed.

Here, when a burr occurs at the connector terminal 10, there are concerns that the burr will protrude from the resin mold 55, the waterproof effect of the resin mold 55 will be insufficient and the connection position with the connector terminal 10 of the electric cable 11 will be permeated by water. Specifically, as in this example, in a case where the electric cable 11, which has the core wire 12 formed of an aluminum or an aluminum alloy, is connected to the connector terminal 10 formed of a copper or a copper alloy, the connection position which is formed of different types of metals is permeated by water and thereby electrolytic corrosion such as contact corrosion between different types of metals occurs.

However, in the embodiment, the cutting groove 44 is formed at the front side in the cutting direction at the interconnection portion 41 that is cut to separate from the carrier 42 and thereby even though the interconnection portion 41 is cut with the cutter 52, the occurrence of a burr can be suppressed at the connector terminal 10.

In other words, according to the connector terminal 10 of the embodiment, a drawback, where a burr protrudes from the resin mold 55 and then the waterproof property is reduced, can be overcome.

Accordingly, the waterproof property of the connection position with the electric cable 11 can be maintained well for a long period of time by the resin mold 55 and high connection reliability can be obtained. Specifically, the core wire 12 formed of the aluminum or the aluminum alloy, is connected to the connector terminal 10 formed of the copper or the copper alloy and thereby, even though copper-aluminum contact, which largely occurs the electrolytic corrosion due to contact between different types of metals, occurs, the connection position of different types of metals can be reliably waterproofed using the resin mold 55 and favorable corrosion resistance can be secured.

In addition, the cutting groove 44 is formed at the interconnection portion 41 and thereby a shearing force or the like which is required to cut in the interconnection portion 41 can be decreased. Accordingly, cutting of the interconnection portion 41 is performed manually and the interconnection portion 41 can be separated from the carrier 42.

In addition, in the embodiment described above, the embodiment illustrates a case where the V-shaped cutting groove 44 is formed at the interconnection portion 41. The shape of the cutting groove 44 is not limited to a V-shape.

Figure 7:
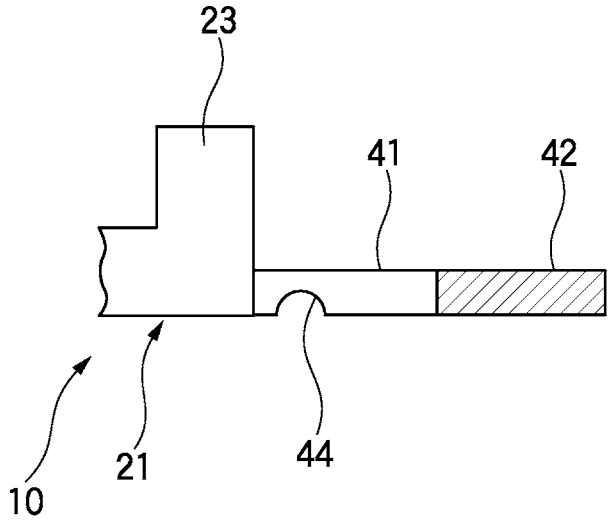
FIG. 7 is a side view of an interconnection portion explaining a modification example of a connector terminal.
Figure 8:
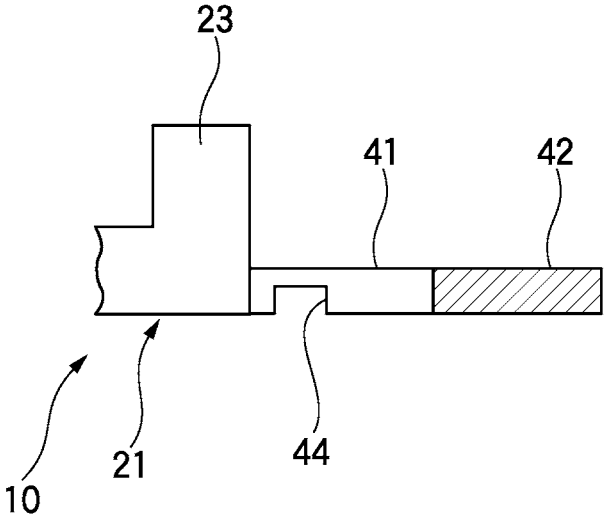
FIG. 8 is a side view of an interconnection portion explaining a modification example of a connector terminal.
Figure 9:
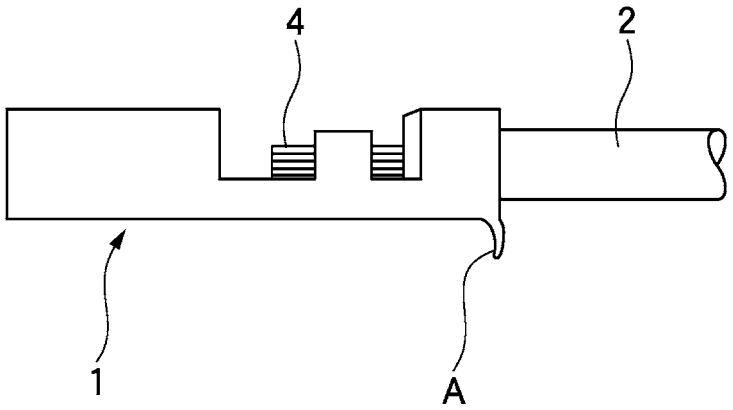
FIG. 9 is a side view of a connector terminal where a burr occurs.
Figure 10:
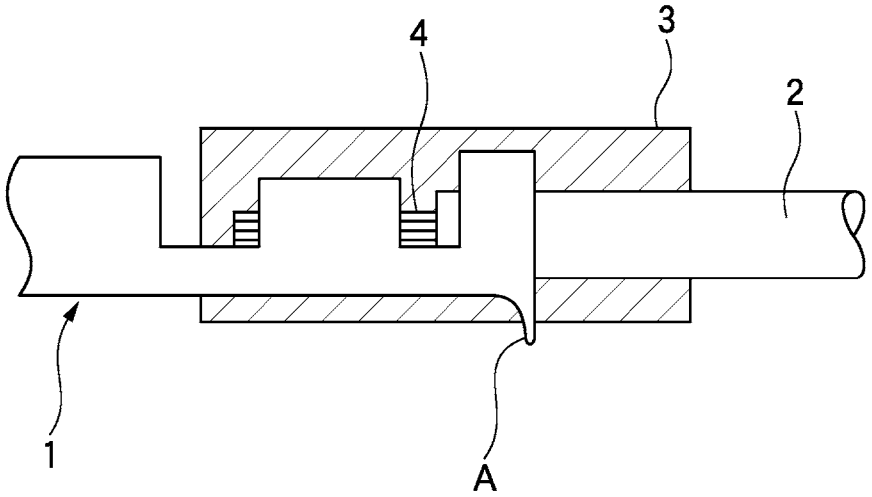
FIG. 10 is a side view of a connector terminal where a resin mold is provided.

As the shapes of the cutting groove 44, as shown in FIG. 7, the groove may be a circular concave shape or as shown in FIG. 8, may be a rectangular concave shape.

In addition, the present invention is not limited to the embodiments described above and can be appropriately altered, improved, or the like. In addition, material, shape, dimension, number, arrangement position, or the like of each of configuration elements in the embodiment described above is arbitrary and is not limited if it can achieve the effects of the present invention.

The present application is based upon and claims the benefit of Japanese patent application No. 2011-181776 filed on Aug. 23, 2011, the contents of which are incorporated by reference in its entirety.

INDUSTRIAL APPLICABILITY

According to the present invention, it is useful to use the connector terminal, especially in a place where water, obstacles or the like can enter, since the connector has favorable protection and corrosion resistance ability in a connection position of a conductor.

REFERENCE SIGNS LIST

10: connector terminal
11: electric cable
12: core wire (conductor)
13: outer cover
21: barrel portion
31: tab terminal portion
41: connection portion
42: carrier
44: cutting groove
55: resin mold

The invention claimed is:

1. A manufacturing method of a connector terminal, comprising:

providing a connector terminal connected to a carrier, the connector terminal comprising a barrel portion to which a conductor exposed from an outer cover of an electric cable is electrically connected, the barrel portion being formed on a top surface of the connector terminal, a tab terminal portion to be electrically connected to a mating terminal, and formed on the top surface of the connector terminal, and an interconnection portion extending from the carrier to the connector terminal in a first direction, the interconnection portion including a cutting groove that extends along a bottom surface of the connector terminal in a second direction that intersects the first direction, wherein the top surface and the bottom surface extend in parallel;

cutting the interconnection portion of the connector terminal through the cutting groove from the top surface along which the cutting groove is extended to separate the connector terminal from the carrier; and forming a resin mold which covers and waterproofs the barrel portion of the connector terminal and an end portion of the electric cable.

* * * * *